US009566639B2

(12) United States Patent
Kohida et al.

(10) Patent No.: US 9,566,639 B2
(45) Date of Patent: Feb. 14, 2017

(54) PRODUCTION METHOD FOR SINTERED MEMBER

(75) Inventors: Tomoyuki Kohida, Matsudo (JP); Katsuhiko Ueda, Matsudo (JP); Kenzou Morita, Matsudo (JP)

(73) Assignee: HITACHI POWDERED METALS CO., LTD., Matsudo-shi (JP)

( * ) Notice: Subject to any disclaimer, the term of this patent is extended or adjusted under 35 U.S.C. 154(b) by 1082 days.

(21) Appl. No.: 13/242,694

(22) Filed: Sep. 23, 2011

(65) Prior Publication Data

US 2012/0082583 A1 Apr. 5, 2012

(30) Foreign Application Priority Data

Sep. 30, 2010 (JP) ..... 2010-222956

(51) Int. Cl.

| | |
|---|---|
| ***B22F 3/16*** | (2006.01) |
| ***B22F 3/17*** | (2006.01) |
| ***B22F 5/08*** | (2006.01) |
| ***B21J 5/00*** | (2006.01) |
| ***B22F 3/24*** | (2006.01) |
| ***C21D 7/06*** | (2006.01) |
| ***C22C 38/04*** | (2006.01) |
| ***C22C 38/08*** | (2006.01) |

(Continued)

(52) U.S. Cl.

CPC ..... *B21J 5/002* (2013.01); *B21K 1/30* (2013.01); *B22F 3/16* (2013.01); *B22F 3/17* (2013.01); *B22F 3/24* (2013.01); *B22F 5/08* (2013.01); *C21D 7/06* (2013.01); *C22C 38/04* (2013.01); *C22C 38/08* (2013.01); *C22C 38/12* (2013.01); *C22C 38/22* (2013.01); *B22F 2998/00* (2013.01); *B22F 2998/10* (2013.01); *C22C 2202/02* (2013.01)

(58) Field of Classification Search

None

See application file for complete search history.

(56) References Cited

U.S. PATENT DOCUMENTS 4,393,563 A * 7/1983 Smith ..... 419/28
5,468,401 A * 11/1995 Lum et al. ..... 508/115

(Continued)

FOREIGN PATENT DOCUMENTS

CN 1222105 A 7/1999
CN 1325775 A 12/2001

(Continued)

OTHER PUBLICATIONS

"Glossary of Metallurgical and Metalworking Terms," Metals Handbook, ASM International, 2002, terms: temper, tempering.*

(Continued)

*Primary Examiner* — Scott Kastler
*Assistant Examiner* — Vanessa Luk
(74) *Attorney, Agent, or Firm* — Oliff PLC

(57) ABSTRACT

A production method for a sintered member includes preparing a raw powder, compacting the raw powder into a green compact having pores at the surface thereof, and sintering the green compact into a sintered compact. The production method also includes sealing the pores exposed at the surface of the sintered compact by at least one of plastically deforming and melting the surface of the sintered compact. The production method further includes forging the sintered compact by using a lubricant after the sealing.

10 Claims, 4 Drawing Sheets

(51) Int. Cl.

| | |
|---|---|
| ***C22C 38/12*** | (2006.01) |
| ***C22C 38/22*** | (2006.01) |
| ***B21K 1/30*** | (2006.01) |

(56) References Cited

U.S. PATENT DOCUMENTS

| | | | | |
|---|---|---|---|---|
| 5,754,937 | A | 5/1998 | Jones et al. | |
| 6,171,546 | B1 | 1/2001 | Mars et al. | |
| 6,193,927 | B1 | 2/2001 | Jones et al. | |
| 6,514,307 | B2 * | 2/2003 | Nakamura et al. | 75/243 |
| 7,416,696 | B2 * | 8/2008 | Kosco | B22F 3/164 419/28 |
| 2003/0155041 | A1 | 8/2003 | Bengtsson et al. | |
| 2003/0176294 | A1 * | 9/2003 | Yamamoto et al. | 508/156 |
| 2011/0045188 | A1 | 2/2011 | Rau et al. | |

FOREIGN PATENT DOCUMENTS

| | | | |
|---|---|---|---|
| CN | 1438926 | A | 8/2003 |
| JP | A-49-120815 | | 11/1974 |
| JP | 62-070504 | A | 4/1987 |
| JP | 01-172502 | A | 7/1989 |
| JP | 01-180904 | A | 7/1989 |
| JP | A-2-209403 | | 8/1990 |
| JP | A-5-70787 | | 3/1993 |
| JP | A-9-194908 | | 7/1997 |
| JP | A-2000-511975 | | 9/2000 |
| JP | A-2001-513143 | | 8/2001 |
| JP | A-2004-502028 | | 1/2004 |
| JP | A-2004-91929 | | 3/2004 |
| JP | A-2009-74113 | | 4/2009 |
| TW | 200932895 | A | 8/2009 |
| WO | WO 97/43458 | A1 | 11/1997 |
| WO | WO 97/47418 | A1 | 12/1997 |
| WO | WO 02/00378 | A1 | 1/2002 |

OTHER PUBLICATIONS

James F. Shackelford and Williams Alexander, CRC Materials Science and Engineering Handbook, 3rd ed., CRC Press, pp. 58-59, 2001.*

J.R. Davis, Surface Engineering of Stainless Steels, Surface Engineering, vol. 5, ASM Handbook, ASM International, 1994, pp. 741-761 (print full version), one (1) page (excerpt online version).*

Joan L. Tomsic (editor), Dictionary of Materials and Testing, Second edition, Society of Automotive Engineers, 2000, p. 344.*

Gangshu Shen, Temperature and Heat Transfer (Ch. 6), Cold and Hot Forging: Fundamentals and Applications, ASM International, 2004, pp. 59-66.*

Japanese Office Action issued in Japanese Application No. 2010-222956 mailed Apr. 30, 2014 (with translation).

Office Action issued in Chinese Application No. 201110315870.4 dated Jul. 26, 2013 (with translation).

Jan. 30, 2015 Notification of Reasons for Rejection issued in Japanese Application No. 2010-222956.

Mar. 10, 2015 Office Action issued in German Application No. 10 2011 115 237.0.

* cited by examiner

PRODUCTION METHOD FOR SINTERED MEMBER

BACKGROUND OF THE INVENTION

1 Technical Field

The present invention relates to a production method for a sintered member. Specifically, the present invention relates to a technique for obtaining a sintered member with high density and high strength by forging after sintering. The sintered member has high density and high strength that are equivalent to those of a wrought steel.

2 Background Art

In a powder metallurgical method, a raw powder including a metallic powder is compacted into a green compact in a predetermined shape with predetermined dimensions. Then, the green compact is sintered at a predetermined temperature, whereby the powder particles are reliably bonded together, and a metallic product of a sintered member is manufactured. According to the powder metallurgical method, a sintered member can be formed in a shape that is near-net-shape of the product, and the sintered member is suitable for mass production. Moreover, a sintered member made of a specific material, which cannot be obtained by a wrought steel, can be produced. Therefore, the sintered members produced by the powder metallurgical method are widely used for automobile machine parts and various industrial machine parts.

In general, when a raw powder is compacted into a green compact, the green compact has spaces among the powder particles, and the spaces in the green compact remain as pores in the sintered member after sintering. Therefore, a sintered member made by the powder metallurgical method tends to have low strength compared with a member made of a wrought steel. In view of this, a great amount of alloying elements may be added to a sintered member, and the matrix of the sintered member is strengthened by the alloying elements. That is, a sintered member has been made by using an alloy that has a higher steel grade than that of an alloy used for a wrought steel. However, since the price of each alloying element has been rising recently, the cost of the raw powder has been increasing. On the other hand, by performing liquid phase sintering, a liquid phase is generated in the green compact, and the liquid phase fills up the spaces among the powder particles and thereby prevents generation of pores. In this case, a sintered member having high accuracy is difficult to obtain, and thereby machining is required after sintering. That is, a sintered member is not formed in a near-net-shape of a product, and the advantage of the powder metallurgical method is not effectively obtained.

In these circumstances, studies for improving strength of a sintered member are disclosed in, for example, PCT International Publications Nos. WO97/047418 and WO02/000378, U.S. Pat. No. 5,754,937, and Japanese Patent Application of Laid-Open No. 2004-091929. PCT International Publication No. WO97/047418 corresponds to U.S. Pat. No. 6,171,546, EP Patent Application of Laid-Open No. 0958077, Japanese Unexamined Patent Application Publication (Translation of PCT Application) No. 2000-511975, and CN Patent Application of Laid-Open No. 1222105. PCT International Publication No. WO02/000378 corresponds to U.S. Patent Application of Laid-Open No. 2003/0155041, EP Patent Application of Laid-Open No. 1294511, Japanese Unexamined Patent Application Publication (Translation of PCT Application) No. 2004-502028, and CN Patent Application of Laid-Open No. 1438926. U.S. Pat. No. 5,754,937 corresponds to U.S. Pat. No. 6,193,927, PCT International Publication No. WO97/043458, EP Patent Application of Laid-Open No. 0910680, and Japanese Unexamined Patent Application Publication (Translation of PCT Application) No. 2001-513143. In the study, densities of a part or the entirety of a sintered member is increased by plastic deforming. Therefore, the amount of pores that may become starting points of fracture is decreased, whereby strength of a matrix is increased.

In the techniques disclosed in PCT International Publications Nos. WO97/047418 and WO02/000378, a sintered member is densified, whereby strength is partially improved. Nevertheless, the sintered member has low overall strength due to the existence of the pores. On the other hand, in the techniques disclosed in U.S. Pat. No. 5,754,937 and Japanese Patent Application of Laid-Open No. 2004-091929, a sintered member is cold forged so as to crush almost all of the pores after sintering. The sintered member has a density equivalent to that of a wrought steel, but the strength is less than that of a wrought steel.

SUMMARY OF THE INVENTION

Accordingly, an object of the present invention is to provide a production method for a sintered member with high density and high strength by forging after sintering. The sintered member has high density and high strength that are equivalent to those of a wrought steel. In addition, another object of the present invention is to provide a gear, a sprocket, and a sintered magnetic core with high density, formed by the production method of the present invention.

The inventors of the present invention have intensively researched in order to improve strength of a sintered member that was forged after sintering. As a result, the inventors of the present invention focused on pores that remained from the surface to the inside of the sintered member that was forged. From this condition, the inventors of the present invention found that since the sintered compact is has a lubricant applied before cold forging, the lubricant infiltrates to the inside through the pores. Therefore, the pores are not crushed due to the lubricant therein. Moreover, the inventors of the present invention found that a layer of the lubricant exists between metallic surfaces of the pore although the pore is crushed. Therefore, metallic bonding does not occur at the pores, whereby the strength of the sintered member is insufficient.

The present invention provides a production method for a sintered member, which was achieved based on the above findings. The production method includes preparing a raw powder, compacting the raw powder into a green compact having pores at the surface thereof, and sintering the green compact into a sintered compact. The production method also includes sealing the pores exposed at the surface of the sintered compact by at least one of plastically deforming and melting the surface of the sintered compact. The production method further includes forging the sintered compact by using a lubricant after the sealing.

As described above, a lubricant infiltrates into the inside pores of a sintered compact and prevents crushing of the inside pores in forging. Moreover, even when a small amount of the lubricant exists in the pores, the lubricant forms a layer between metallic surfaces of the pores by crushing, and thereby prevents bonding of the metallic surfaces of the pores. In contrast, in the present invention, the pores exposed at the surface of the sintered compact are sealed before the forging, whereby the lubricant is prevented from infiltrating to the inside of the sintered compact. Therefore, sufficient density and strength are obtained by the forging.

In a case of sealing the pores by the plastic deforming, the pores exposed at the surface of the sintered compact are deformed, whereby notch sensitivity is decreased. Usually, the pores exposed at the surface have large depths and remain as notches even when the forging is performed. In contrast, by plastically deforming the surface before the forging, vicinities of the pores are dented, and the depths of the pores are decreased. Therefore, the amount of the pores that may act as notches is decreased after the forging.

Moreover, the surface of the sintered compact is work hardened by the plastic deforming, whereby frictional resistance between the surface of the sintered compact and a die assembly is decreased. For example, when a soft material such as a soft steel is forged, the material may stick to the inside surface of a die assembly. On the other hand, in the present invention, the sticking of the sintered compact is prevented by work hardening the surface of the sintered compact.

At least one of the plastic deforming and the melting of the surface is applied to at least a portion of a sintered compact, in which high strength is required in a product. For example, when the sintered member is used for an external gear or an internal gear as a machine part, at least teeth portions are required to have high strength. The teeth portions are formed by surfaces at which the sintered member slidably contacts with a die assembly or a core rod, while the sintered member is pulled out from the die assembly after the forging. Therefore, the plastic deforming or the melting of the surface is desirably performed on at least a surface of a sintered compact, which faces a direction perpendicular to a compression direction of the forging. When the sintered member is used for a bevel gear or a face gear, at least teeth portions are required to have high strength. The teeth portions are formed by a step portion or a punch surface of a die assembly, which has a hole formed with the step portion and having a larger diameter portion and a smaller diameter portion. Therefore, in this case, the plastic deforming or the melting of the surface is desirably performed on at least a surface of a sintered compact, which faces a compression direction of the forging.

It should be noted that "sealing of the pores" is closing of the pores exposed at the surface of the sintered compact. Moreover, the phrase "sealing of the pores" may include blocking off of the communications between the pores exposed at the surface of the sintered compact and the inside pores and may include blocking off of the communications among the inside pores. The plastic deforming is desirably performed so as to seal the pores existing in the area of 25 to 150 μm in depth from the surface of the sintered member. If the pores only in the area of less than 25 μm in depth from the surface are sealed, the pores easily communicate with the inside pores in the forging, and the lubricant easily infiltrates to the inside of the sintered compact. On the other hand, even if the pores in the area of more than 150 μm in depth from the surface are sealed, the effects are not further obtained, and energy for the plastic deforming is used more than necessary. When the plastic deforming is performed by shot peening, which will be described later, the pores in the area of not more than 150 μm in depth from the surface is sealed (plastically deformed) at most. In view of the influences of the area in which the pores are sealed, the area is desirably 50 to 100 μm in depth from the surface.

In the present invention, the forging may be performed by cold forging, warm forging, or hot forging. The cold forging is performed without heating the material. The warm forging is performed by heating the material at a temperature of from 400 to 700° C. The hot forging is performed by heating the material at a temperature of from 700 to 1200° C. In the cold forging, a lubricant of a stearic acid type is used. On the other hand, in the warm forging and the hot forging, a lubricant of a carbon type is used.

In the cold forging, the lubricant desirably includes at least two kinds of powders having a different melting point. In this case, after the lubricant is applied to the sintered compact, the powder having a lower melting point is melted and is solidified, thereby adhering the powder having a higher melting point to the sintered compact. Therefore, the lubricant is not easily exfoliated from the sintered compact, and a yield rate of the lubricant is improved. The powder having a lower melting point desirably has a melting point of 60 to 140° C., and the powder having a higher melting point desirably has a melting point of 200 to 250° C. The powder having a lower melting point is, for example, a zinc stearate, and the powder having a higher melting point is, for example, a lithium stearate.

The powder having a lower melting point desirably has an average particle size of 10 to 20 μm, and the powder having a higher melting point desirably has an average particle size of 10 to 100 μm. If the powder having a higher melting point has an average particle size of more than 100 μm, the overall volume of the powder is large. Moreover, the powder particles dent into the surface of the sintered compact in the forging and cause roughness of the sintered member. On the other hand, when the powder has a smaller average particle size, the lubricating effect is obtained with a smaller amount of the powder, and roughness of the sintered member is prevented. Nevertheless, since the particle size of an available powder is limited, the average particle size of the powder having a higher melting point is set to have a lower limit of 10 μm. The powder having a higher melting point more desirably has an average particle size of 15 to 60 μm in view of availability.

The plastic deforming may be performed by shot peening. The shot peening is desirably performed so that the sintered compact has a surface roughness Ra of 2 to 6 μm. The surface roughness Ra is specified in Japanese Industrial Standards HS B0601:1994. By forming the surface roughness Ra of the sintered compact to be not less than 2 μm, a specific surface area of the sintered compact is increased, and the powders of the lubricant are efficiently maintained on the surface of the sintered compact. Therefore, the yield rate of the lubricant is improved. On the other hand, if the surface roughness Ra is greater than 6 μm, dented portions will act as notches after the forging. The surface roughness Ra is more desirably set to be 2 to 4 μm.

The shot peening may be performed by a method of projecting shot from an impeller, or by a method of spraying shot from a nozzle. In the latter method, a shot peening device provided with a reflector at a leading end side of a nozzle may be used. In this case, the plastic deforming can be performed on an inner circumferential surface of a sintered compact with a hole or a recess at the center thereof.

The plastic deforming may be performed by roll forming. Alternatively, the plastic deforming may be performed by using an ultrasonic generator. In this case, the ultrasonic generator is mounted with a tool, and the tool is contacted to the surface of the sintered compact. Thus, the plastic deforming can be performed by a variety of methods, and publicly known means may be used.

In order to seal the pores exposed at the surface of the sintered compact by melting, laser light may be used. In this case, the surface of the sintered compact is scanned by the laser light and is thereby melted. The scanning of the laser light is performed on the entire surface of the sintered compact so as to melt the entire surface.

When the forging is performed so that the sintered compact has a density ratio of not less than 97.8%, high density and high strength, which are equivalent to those of a wrought steel, are obtained.

After the sintered compact is forged, quenching treatment such as bright quenching and carburizing quenching may be performed. The quenching treatment may be performed under ordinary conditions. After the carburizing quenching, tempering is desirably performed.

The sintered compact as a material for a sintered member may be made of one of iron-based sintered materials for various mechanical structural parts that are conventionally used. For example, materials specified in Japanese Industrial Standards JIS Z2550 may be used. That is, SMF Class 1 (pure iron series), SMF Class 2 (iron-copper series), SMF Class 3 (iron-carbon series), SMF Class 4 (iron-copper-carbon series), and SMF Class 5 (iron-nickel-copper-carbon series), may be used. In addition, SMF Class 6 (iron-copper-carbon series), SMF Class 7 (iron-nickel series), SMF Class 8 (iron-nickel-carbon series), SMS Class 1 (austenite stainless steels), and SMS Class 2 (ferrite stainless steels), may be used. Moreover, 4600 series (iron-nickel-molybdenum series) or 4100 series (iron-chromium-manganese series), specified by the American Iron and Steel Institute (AISI), may be used.

In these iron-based sintered materials, the amount of C is preferably not more than 0.6 mass % in order to generate deformation and facilitate densification of the sintered compact in the forging. In this case, if more than 0.6 mass % of C is required for the sintered material as a product, the insufficient amount of C is preferably supplied by heat treatment in a carburizing atmosphere after the forging. Moreover, spheroidizing annealing may be performed before the forging, whereby the matrix of the sintered material is made to be easily plastically deformed.

As a raw powder used in the present invention, the following raw powders may be used in order to obtain the above iron-based sintered material. That is, a raw powder of a mixture of an iron powder, single powders including single alloying element, and a graphite powder, may be used. Moreover, an iron alloy powder alloyed with various elements, or a raw powder of a mixture of the iron alloy powder, the single powders, and the graphite powder, may be used. For example, in a case of forming a material of 4600 series specified by AISI as a sintered material, a mixture of an iron alloy powder and 0.2 to 0.6 mass % of a graphite powder may be used. In this case, the iron alloy powder may consist of, by mass %, 0.4 to 1.0% of Ni, 0.2 to 1.0% of Mo, 0.1 to 0.5% of Mn, and the balance of Fe and inevitable impurities. In a case of forming a material of 4100 series specified by AISI as a sintered material, a mixture of an iron alloy powder and 0.2 to 0.6 mass % of a graphite powder may be used. In this case, the iron alloy powder may consist of, by mass %, 0.4 to 1.0% of Cr, 0.2 to 1.0% of Mo, 0.1 to 0.8% of Mn, and the balance of Fe and inevitable impurities.

In the present invention, structural mechanical parts such as gears and sprockets, and magnetic parts such as sintered magnetic cores, can be formed. The present invention also provides these sintered members.

According to the present invention, infiltrating of a lubricant to the inside of the sintered compact is prevented, whereby a sintered member with high density and high strength that are equivalent to those of a wrought steel is obtained by the forging.

BRIEF DESCRIPTION OF THE DRAWINGS

FIG. 1A is a top view of the gear, FIG. 1B is a side view of the gear, FIG. 1C is a cross sectional view of the gear taken along line C-C in FIG. 1A, and FIG. 1D is a perspective view of the gear.

FIGS. 3A to 3C are shown in the order of steps.

PREFERRED EMBODIMENT OF THE INVENTION (1) Sintered Member

In this embodiment, for example, a gear G shown in FIGS. 1A to 1D is formed. As shown in FIGS. 1A to 1D, the gear G has a body 10 with a disk shape, plural teeth portions 11, and a mounting hole 12. The teeth portions 11 are formed so as to project radially from the outer circumference of the body 10 at equal interval. The mounting hole 12 is formed at the central portion of the body 10.

(2) Preparing Step

In this embodiment, for example, a raw powder is prepared so that the entire composition has that of a case hardened steel (carburized steel). For example, in entire composition, 0.3% of a graphite powder and 0.8% of a forming lubricant such as zinc stearate are mixed with an iron alloy powder. The iron alloy powder consists of, by mass %, 0.5% of Ni, 0.5% of Mo, 0.2% of Mn, and the balance of Fe and inevitable impurities. The iron alloy powder has an average particle size of 70 μm.

(3) Compacting Step

The compacting of the raw powder is performed by using a die assembly. The raw powder is compacted into a green compact having a smaller size in the diametrical direction and a larger thickness than those of the gear G shown in FIGS. 1A to 1D. The green compact is made to have a density of not less than 7.0 $Mg/m^3$ as a whole.

(4) Sintering Step

The sintering may be performed under ordinary conditions. In this case, if oxidation occurs in the sintering step, the sintered compact as a material is hardened and is difficult to plastically deform. Therefore, the sintering is preferably performed in an atmosphere of nonoxidizing gas, such as nitrogen gas or a mixed gas of nitrogen and hydrogen, or in a vacuum atmosphere. The sintering may be performed at approximately 1000 to 1250° C.

(5) Sealing Step

Figure 1A:
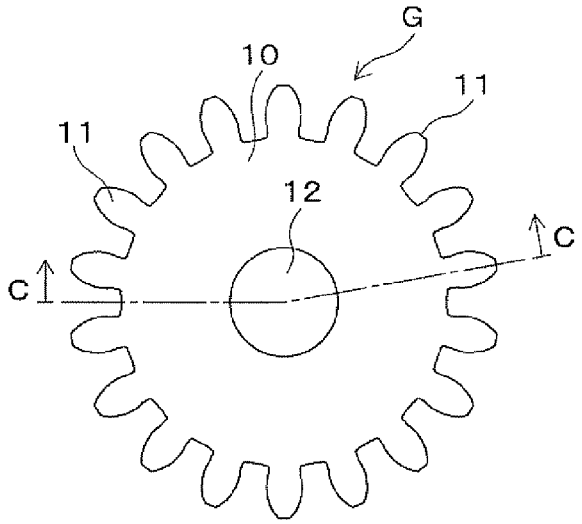
FIGS. 1A to 1D show a gear formed in a preferred embodiment of the present invention.
Figure 1B:
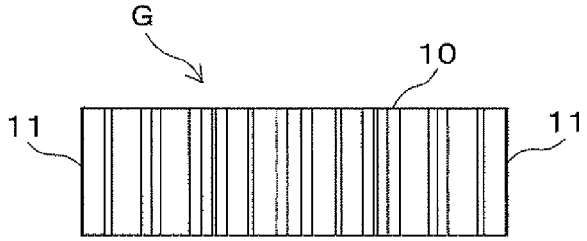
Figure 1C:
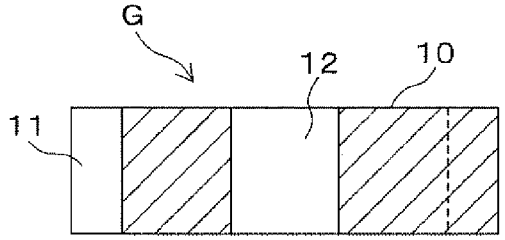
Figure 1D:
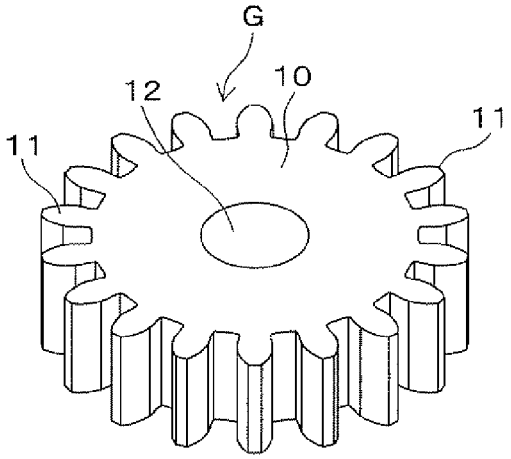
Figure 2A:
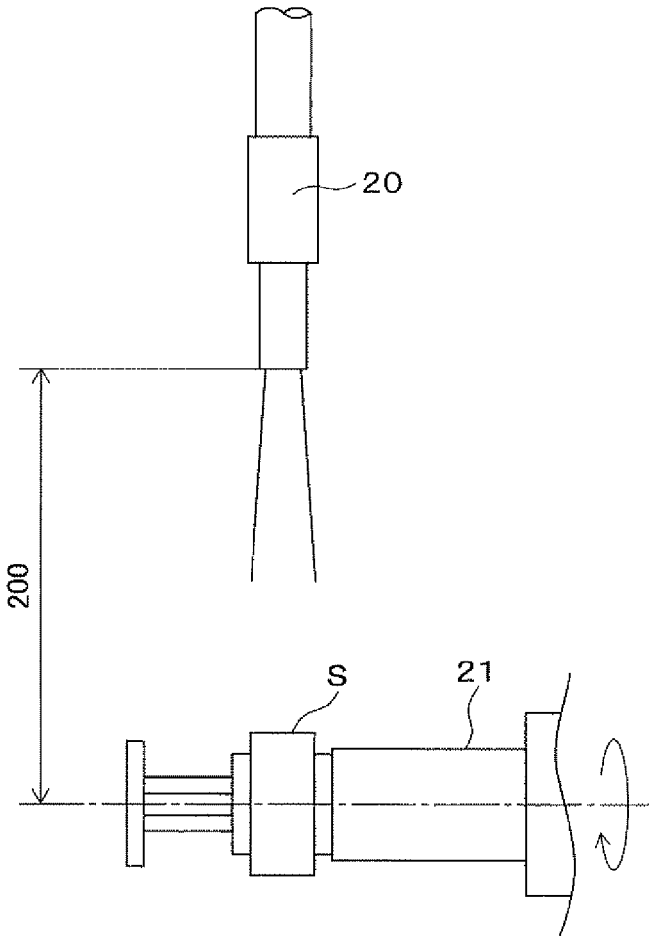
FIGS. 2A and 2B are side views of shot peening devices used in a preferred embodiment of the present invention.
Figure 2B:
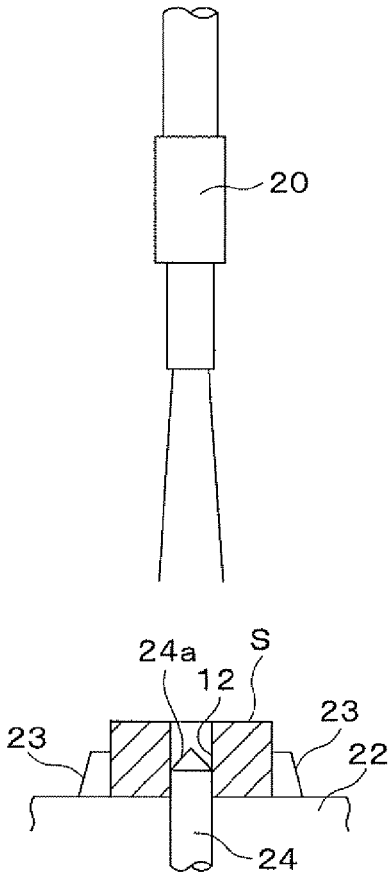

In this embodiment, the sealing is performed by shot peening. FIGS. 2A and 2B are side views showing shot peening devices. FIG. 2A shows a device for shot peening an outer circumferential surface of a sintered compact S. FIG. 2B shows a device for shot peening an inner circumferential surface of the mounting hole 12. In FIGS. 2A and 2B, a reference numeral 20 denotes a nozzle for spraying shot downwardly. A reference numeral 21 denotes a chuck for holding the sintered compact S by infiltrating through the mounting hole 12, and the chuck rotates around the axis in a horizontal direction. The shot sprayed from the nozzle 20 hits the outer circumference of the sintered compact S and plastically deform the surface of the sintered compact S. Therefore, the pores exposed at the surface of the sintered compact S are sealed. As the shot, steel balls having an average particle size of 300 to 400 μm are preferable.

As shown in FIG. 2B, a work table 22 is arranged at a lower side of the nozzle 20, and a chuck 23 is arranged on a top surface of the work table 22. The chuck 23 holds the sintered compact S by the outer circumference. Moreover, a reflective rod 24 is vertically movably arranged to the work table 22 and appears to the top surface of the work table 22 as necessary. The reflective rod 24 has a top surface formed with a conical surface 24*a* having a vertex angle of 90°.

The shot sprayed from the nozzle 20 enters the inside of the mounting hole 12 and are reflected at the conical surface 24*a*, thereby hitting the inner circumferential surface of the mounting hole 12. In this case, the reflective rod 24 is downwardly moved so that the shot peening is performed on the entire inner circumferential surface of the mounting hole 12.

(6) Forging Step

Figure 3A:
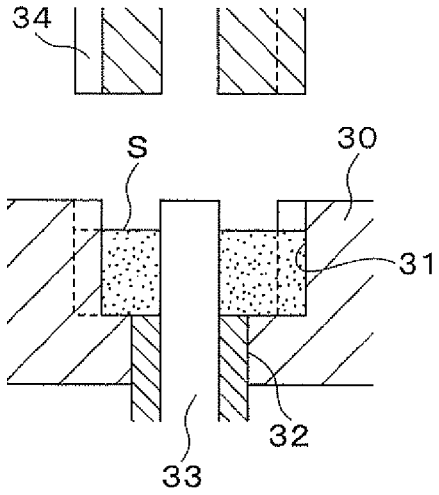
FIGS. 3A to 3C are cross sectional views of a forging die assembly used in a preferred embodiment of the present invention.
Figure 3B:
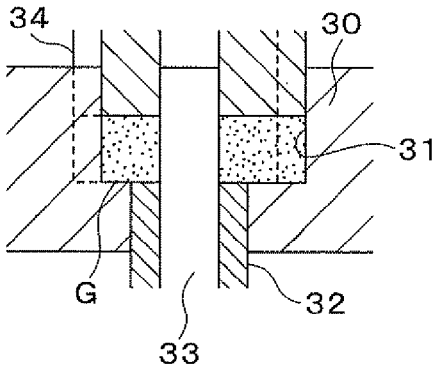
Figure 3C:
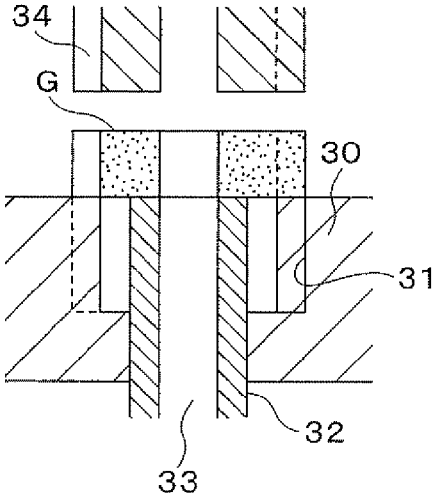

FIGS. 3A to 3C are cross sectional views showing a forging die assembly. In FIGS. 3A to 3C, a reference numeral 30 denotes a die. Recess portions 31 are formed at an inner circumferential surface of the die 30, which corresponds to the teeth portions 11 of the gear shown in FIGS. 1A to 1D. A cylindrical ejection pin 32 is vertically movably fitted to a central portion of the die 30. A columnar core rod 33 is inserted to a central portion of the ejection pin 32. A punch 34 is supported at an upper side of the die 30 so as to be vertically movable, and the punch 34 is made to fit to the inner circumferential surface of the die 30.

In order to forging the sintered compact S using the die assembly shown in FIGS. 3A to 3C, first, a lubricant is applied to the outer circumferential surface and the inner circumferential surface of the sintered compact S. For example, the lubricant is made of zinc stearate having a melting point of approximately 125° C. and lithium stearate having a melting point of approximately 220° C. The lubricant may be applied by brush or by spray gun for spraying powders using compressed air. Then, the sintered compact S is placed in a heating furnace and is heated to a temperature at which the zinc stearate is melted. Next, the sintered compact S is taken out from the heating furnace and is cooled, whereby the zinc stearate is solidified. Therefore, a film of the zinc stearate in a solid state is formed on the surface of the sintered compact S, and the film adheres the lithium stearate to the surface of the sintered compact S.

Next, the sintered compact S is inserted into the die 30. The sintered compact S is formed so as to have clearances between the outer circumferential surface of the sintered compact S and the inner circumferential surface of the die 30, and between the mounting hole 12 of the sintered compact S and the core rod 33. In this condition, the punch 34 is lowered, and the sintered compact S is compacted at a pressure of 1500 to 2500 MPa (see FIG. 3A). In this case, the compression rate (compacted thickness/original thickness) is set to be 8.1 to 9.3%. In addition, the sintered compact S is compacted so as to have a density of not less than 7.7 $Mg/m^3$ and to have a density ratio of not less than 97.8%.

Then, the ejection pin 32 is raised, and the forged gear G is pushed up to the top surface of the die 30. At this time, frictional heat is generated between the gear G and the die 30 and between the gear G and the core rod 33, whereby, the powders of the lubricant are melted and lubricate the sliding surfaces. Also, when the punch 34 is lowered for forging, the material of the sintered compact S slidingly contacts the die 30 and generates frictional heat. Therefore, the powders of the lubricant are melted and lubricate the sliding surfaces. In this case, since the pores exposed to the side surface and the inner circumferential surface of the sintered compact S and the gear G are sealed, the lubricant is prevented from infiltrating into the inside through the pores.

(7) Heat Treatment Step

A heat treatment is performed in order to metallurgically bond the pores that are crushed by the forging. In a case of a material including C, a heat treatment is performed in order to modify and refine the metallic structure that is dislocated by the forging. In addition, a heat treatment is also performed in order to improve strength of the forged compact by forming a metallic structure of martensite with high strength. In the heat treatment, the forged compact is heated to not less than an austenitizing temperature range of the sintered material in any objective cases.

When the heat treatment is performed so as to form a metallic structure of martensite with high strength, the forged compact is quenched in oil or water after the heating. In such a quenching treatment, if the heating is performed in a nonoxidizing atmosphere excluding carburizing gas, bright quenching treatment is performed. The bright quenching treatment is performed when the amount of C included in the sintered compact is sufficient as a product, that is, when a large amount of C is not required in a product.

On the other hand, when a large amount of C is required in a product, the amount of C of the sintered compact is preferably set to be not more than 0.6 mass %. Then, in order to provide the insufficient amount of C, the heating is performed in a carburizing atmosphere in the heat treatment, and a carburizing quenching treatment may be performed. Thus, the amount of C of the sintered compact is decreased, and the insufficient amount of C is provided in a carburizing atmosphere in the subsequent heat treatment. In this case, the sintered compact as a material is easily deformed in the above-described forging.

Since the quenched compact has a large hardening strain and is brittle, a tempering treatment is preferably performed after the quenching treatment. The tempering may be performed in the same way as in tempering of ordinary steel materials and sintered materials, and may be performed at around 180° C. in the air.

As described above, in the above embodiment, the lubricant is prevented from infiltrating into the inside through the pores, whereby a gear G having sufficient density and strength is formed by the forging.

EXAMPLES

(1) Preparation of Gear

The present invention will be described in detail with reference to practical examples hereinafter. An iron-based alloy powder (average particle size: 70 μm), a graphite powder, and a zinc stearate powder were prepared. The iron-based alloy powder consisted of, by mass %, 0.5% of Cr, 0.2% of Mo, 0.2% of Mn, and the balance of Fe and inevitable impurities. Then, 0.3 mass % of the graphite powder and 0.8 mass % of the zinc stearate powder were mixed with the iron-based alloy powder into a raw powder.

A predetermined amount of the raw powder was weighed and was filled into a die assembly, and the raw powder was compacted at 700 MPa into a green compact. The green compact had a density of 7.0 $Mg/m^3$ and a density ratio of 90%.

The green compact was placed in a sintering furnace in which the atmosphere was adjusted to consist of 5 volume % of $H_2$ and 95 volume % of $N_2$. Then, the green compact was sintered at 1120° C. for 20 minutes, and was taken out from the sintering furnace and was cooled, whereby a sintered compact was obtained. The sintered compact had a density of 7.0 $Mg/m^3$ and a density ratio of 90%.

The sintered compact was mounted to a chuck 21 of a shot peening device shown in FIG. 2A. The sintered compact was sprayed with shot (manufactured by Sintokogio, Ltd., SB-3) from a nozzle 20 for 6 seconds while the sintered compact was rotated at 30 rpm. The shot was sprayed at 0.2 MPa. The distance from the leading end of the nozzle 20 to the rotational center of the chuck 21 was set to be 200 mm. The shot peening was performed so that the arc height was 0.172 mmA (almen strip material) and the coverage was 98% or more.

Next, a lubricant was applied to the side surface (teeth portions) of the sintered compact, which was subjected to the shot peening. The lubricant included 50 mass % of zinc stearate and the balance of lithium stearate. The zinc stearate had an average particle size of 20 μm, and the lithium stearate had an average particle size of 30 μm.

The sintered compact was inserted into a die assembly shown in FIGS. 3A to 3C. The sintered compact had a clearance of 0.1 mm from each of the die 30 and the core rod. The sintered compact was compacted at 1800 MPa so that the compression rate (compacted thickness/original thickness) was 10%, whereby a gear was obtained. The gear had a density of 7.7 $Mg/m^3$ and a density ratio of 97.8%.

The gear was placed in a carburizing gas atmosphere in a heating furnace and was heated at 920° C. for 120 minutes. Then, the gear was held for 15 minutes after the heating furnace was cooled to 820° C., and the gear was rapidly cooled in oil. Moreover, the gear was tempered at 180° C. for 60 minutes.

(2) Investigation of Surface Roughness

After the green compact was subjected to each of the sintering, the shot peening, the application of the lubricant, and the forging, surface roughnesses Ra were measured at three roots of the teeth thereof. The results are shown in Table 1. The sintered compact after the sintering had a surface roughness Ra of 1.0 μm and had an extremely smooth surface. After this sintered compact was subjected to the shot peening, the surface roughness Ra was increased to 3.9 μm. Although the shot peening was performed, by forging the sintered compact after the application of the lubricant, the average of the surface roughnesses Ra was decreased to 1.3 μm.

TABLE 1

| | Measuring point No. | | | |
|---|---|---|---|---|
| Step | 1 | 2 | 3 | Average |
| 1 | 0.8 μm | 1.2 μm | 1.0 μm | 1.0 μm |
| 2 | 3.5 μm | 3.5 μm | 4.4 μm | 3.8 μm |

TABLE 1-continued

| | Measuring point No. | | | |
|---|---|---|---|---|
| Step | 1 | 2 | 3 | Average |
| 3 | 3.6 μm | 3.9 μm | 4.1 μm | 3.9 μm |
| 4 | 1.6 μm | 1.3 μm | 1.1 μm | 1.3 μm |

Figure 4:
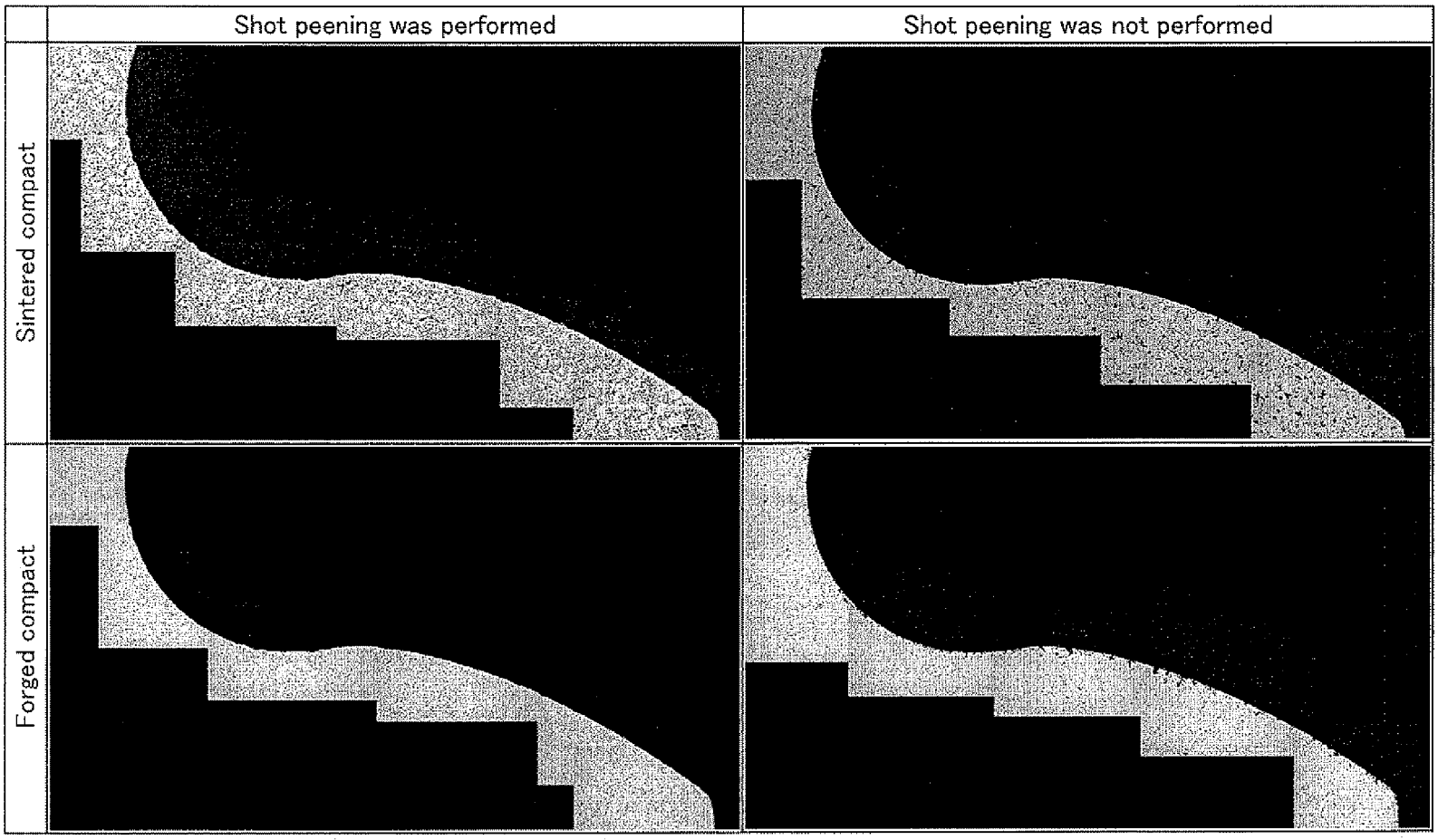
FIG. 4 shows cross sectional views of teeth portions of gears formed in a practical example of the present invention.

1: Sintering
2: Sintering + Shot peening
3: Sintering + Shot peening + Application of lubricant
4: Sintering + Shot peening + Application of lubricant + Forging (3) Investigation of Pores FIG. 4 shows cross sectional views of portions from the root to the top of the teeth of sintered compacts and forged compacts, in which the shot peening was performed and was not performed. As shown in FIG. 4, when the shot peening was not performed on the sintered compact, numerous pores were exposed to the surface of the sintered compact. In contrast, when the shot peening was performed on the sintered compact, the pores that had been exposed to the surface disappeared, and the sintered compact had a layer without pores from the surface to the inside. Moreover, when the forging was performed on this sintered compact, the pores in almost the entirety of the sintered compact were crushed. On the other hand, when the forging was performed on a sintered compact that was not subjected to the shot peening, the pores were exposed to the surface and also remained inside the sintered compact.

(4) Another Example

An iron-based alloy powder (average particle size: 70 μm) consisting of, by mass %, 0.5% of Ni, 0.5% of Mo, 0.2% of Mn, and the balance of Fe and inevitable impurities, was prepared. Then, 0.3 mass % of the graphite powder and 0.8 mass % of the zinc stearate powder were mixed with the iron-based alloy powder into a raw powder. The raw powder was formed into a gear in the same way as in the above example. As a result, the gear exhibited characteristics equivalent to those of the above example.

According to the present invention, density and strength that are equivalent to those of a wrought steel are obtained. Therefore, the present invention can be applied to sintered members for receiving large stress from a mating member, such as gears and sprockets. The present invention also can be applied to sintered members for receiving large centrifugal force, such as sintered magnetic cores for motors.

What is claimed is:

1. A production method for a sintered member, comprising:

preparing a raw powder;

compacting the raw powder into a green compact having pores at a surface thereof;

sintering the green compact into a sintered compact;

sealing the pores exposed at the surface of the sintered compact by performing shot peening to the surface of the sintered compact;

applying a lubricant to the sintered compact, the lubricant including at least two kinds of powders having different melting points, a first one of the powders having a lower melting point and a second one of the powders having a higher melting point;

heating the sintered compact such that the first one of the powders having the lower melting point is melted;

cooling the sintered compact such that the melted first one of the powders is solidified, thereby adhering the second one of the powders having the higher melting point to the sintered compact; and cold forging the sintered compact after the cooling.

2. The production method for the sintered member according to claim 1, wherein the shot peening is applied to at least a portion of the sintered compact, in which high strength is required as a product.

3. The production method for the sintered member according to claim 1, wherein the shot peening is performed so as to seal the pores existing in an area of 25 to 150 μm in depth from the surface of the sintered member.

4. The production method for the sintered member according to claim 1, wherein the shot peening is performed so as to seal the pores existing in an area of 50 to 150 μm in depth from the surface of the sintered member.

5. The production method for the sintered member according to claim 1, wherein the first one of the powders having the lower melting point has a melting point of 60 to 140° C., and the second one of the powders having the higher melting point has a melting point of 200 to 250° C.

6. The production method for the sintered member according to claim 1, wherein the second one of the powders having the higher melting point has an average particle size of 10 to 100 μm.

7. The production method for the sintered member according to claim 1, wherein the second one of the powders having the higher melting point has an average particle size of 15 to 60 μm.

8. The production method for the sintered member according to claim 1, wherein the shot peening is performed so that the sintered compact has a surface roughness Ra of 2 to 4 μm.

9. The production method for the sintered member according to claim 1, wherein the cold forging is performed so that the sintered compact has a density ratio of not less than 97.8%.

10. The production method for the sintered member according to claim 1, wherein the sintered compact is carburized and quenched and is then tempered after the cold forging.

* * * * *